United States Patent [19]

Etzion

[11] Patent Number: 4,812,341

[45] Date of Patent: Mar. 14, 1989

[54] FLOWER-LIKE ORNAMENT

[75] Inventor: Raphael Etzion, Great Neck, N.Y.

[73] Assignee: Variety Accessories, Inc., Great Neck, N.Y.

[21] Appl. No.: 145,461

[22] Filed: Jan. 19, 1988

[51] Int. Cl.[4] ..... A41G 1/00

[52] U.S. Cl. ..... 428/24; 156/61; 428/90

[58] Field of Search ..... 428/24, 25, 26, 90; 156/61

[56] References Cited

U.S. PATENT DOCUMENTS

| | | | |
|---|---|---|---|
| 2,552,274 | 5/1951 | Gentile | 428/90 X |
| 2,792,655 | 5/1957 | Kroczynski et al. | 428/24 X |
| 2,876,575 | 3/1959 | Leika | 428/90 X |
| 2,901,373 | 8/1959 | Weiss | 428/90 X |
| 3,565,736 | 2/1971 | Jason | 428/24 X |
| 3,709,767 | 1/1973 | Saiga | 428/24 X |

*Primary Examiner*—Henry F. Epstein

*Attorney, Agent, or Firm*—Robin, Blecker & Daley

[57] ABSTRACT

A flower-like ornament comprised of a plurality of interconnected strips of material which are creased and centrally compressed and held to form the ornament.

15 Claims, 4 Drawing Sheets

FLOWER-LIKE ORNAMENT

BACKGROUND OF THE INVENTION

This invention relates to ornaments and, in particular, to flower-like ornaments.

Ornaments having a flower-like or bow-like configuration such as, for example, a poinsettia shape, are well known and find significant use as decorations, particularly, during the holiday season. Typically, ornaments of this type are fabricated using a number of separated, flat strips of material whose ends are tapered or inclined inwardly to form points.

In fabricating a flower-like ornament with these strips, the strips are first individually double creased longitudinally. The creased strips in aligned, adjacent relationship are then compressed and held together at a central region. Once the central region is tied, the portions of the strips which extend from the compressed central region form petal-like configuration for the ornament. By bending and adjusting these portions in varying amounts, the desired flower-like ornament results.

Because of the inability to easily hold and align the separate creased strips, the above fabrication procedure is time consuming and difficult. Furthermore, the symmetry realized from ornament-to-ornament is not always consistent. This has caused fabricators to look to other ways of fabrication. One way which has found some degree of use is to hold the creased strips together in a jig or other holder during the fabrication process. However, this procedure increases the cost of fabrication and has not significantly decreased the fabrication time.

It is an object of the present invention to provide a flower-like ornament whose configuration is such as to allow for quicker and easier fabrication.

It is a further object of the present invention to provide a flower-like ornament whose configuration is such as to allow for more consistent symmetry from ornament-to-ornament in the fabrication process.

SUMMARY OF THE INVENTION

In accordance with the principles of the present invention, the above and other objectives are realized in a flower-like ornament of the above-described type wherein the strips for forming the ornaments are such that each strip is connected to its adjacent strips. As a result of this interconnection of the strips, the strips are more readily brought together and aligned during the fabrication process. Fabrication can thus be more quickly and easily accomplished.

In the embodiment of the invention to be disclosed hereinafter, the plurality of interconnected strips are formed from a single piece of material which has been cut longitudinally from opposite ends at spaced positions along its width. Also, in a further aspect of the invention, a further strip of longer overall length can be fabricated with the plurality of strips to form a bottom streamer for the ornament.

BRIEF DESCRIPTION OF THE DRAWINGS

The above and other features and aspects of the present invention will become more apparent upon reading the following detailed description in conjunction with the accompanying drawings, in which.

DETAILED DESCRIPTION

Figure 1:
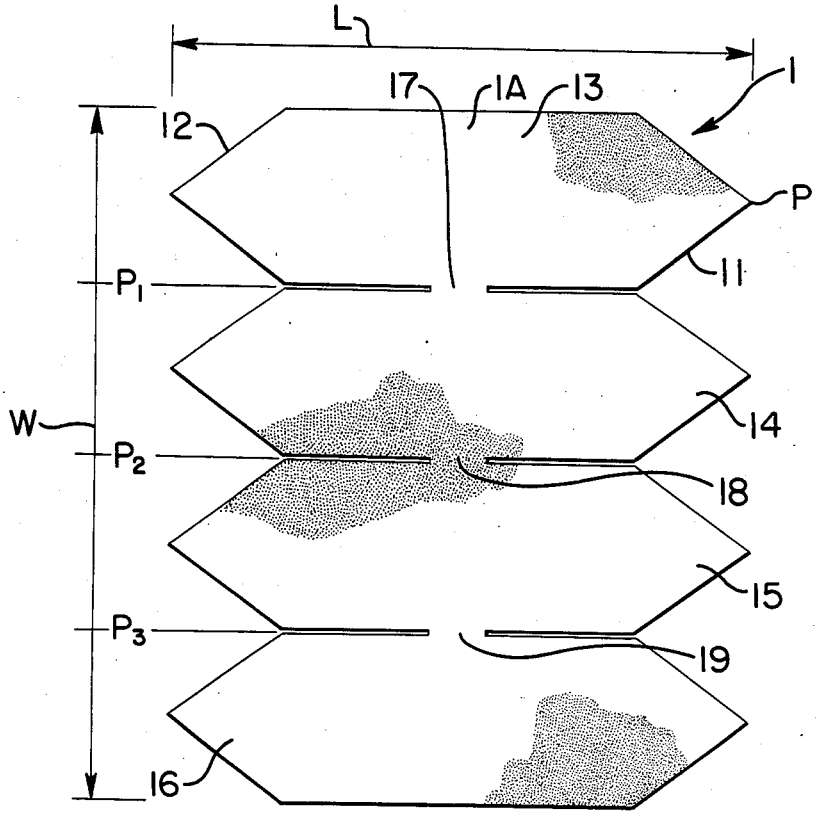
FIG. 1 illustrates a plurality of interconnected strips of material, for forming a flower-like ornmanet in accordance with the principles of the present invention.

In FIG. 1, an article of material 1 for fabricating a flower-like ornament in accordance with the invention is shown. The material 1 is of length L and width W and has an upper surface 1A comprised of a decorative material such as a flocked material of the type used in making Christmas decorations.

At equally spaced positions P1, P2 and P3 along its width W, the material 1 is slit longitudinally from opposite longitudinal ends 11 and 12. These slits extend toward each other short of connecting so that they segment the material 1 into a plurality of flat, elongated strips of material 13, 14, 15 and 16 which are connected at respective central areas 17, 18 and 19 of limited extent. As will be discussed below, it is these connecting areas 17–19 which facilitate forming the strips 13–16 into a flower-like ornament. In usual configuration, each of the strips 13–16 at each of its longitudinal ends has its upper and lower surfaces tapered or inclined linewise inwardly to meet a point P.

Figure 2:
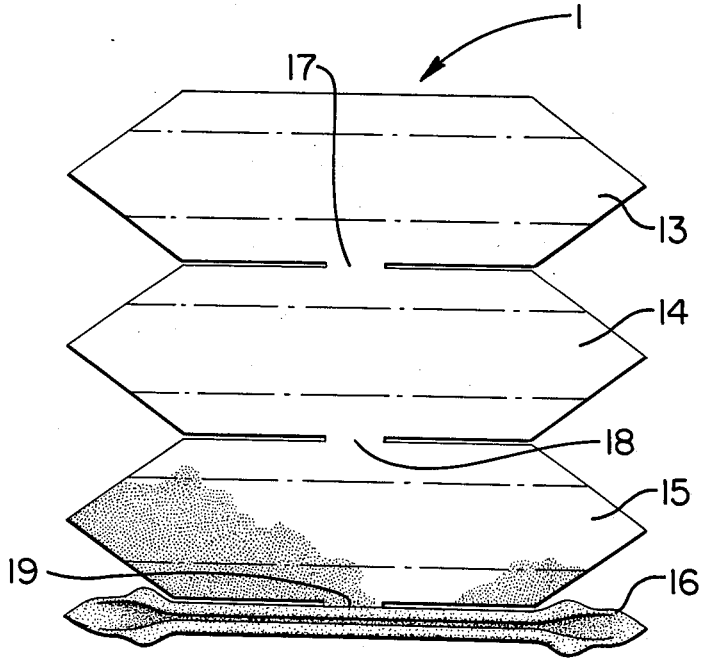
FIG. 2 illustrates the strips of material of FIG. 1 after one of the strips has been creased in fabricating the material into a flower-like ornament.
Figure 3:
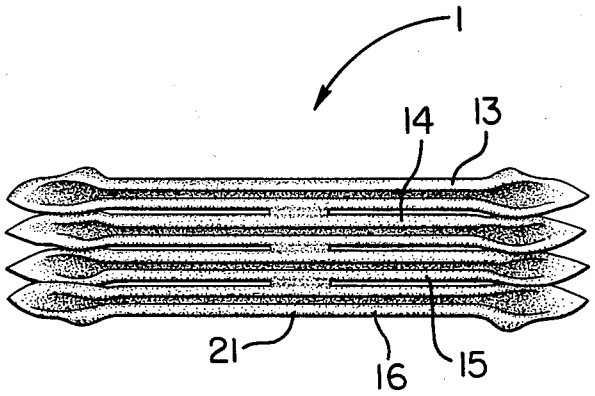
FIG. 3 illustrates the strips of material of FIG. 1 after all the strips have been creased in fabricating the material into a flower-like ornament.

With the material 1 segmented into the interconnected strips 13-16 as shown in FIG. 1, formation of a flower-like ornament is initiated by creasing the strip 16 longitudinally at a first width position and then at a second width position as shown in FIG. 2. Because of the central connecting area 19, the creasing of the strip 16 draws the next strip 15 to the creasing region in alignment with the strip 16. The strip 15 is then similarly double creased and this procedure is repeated for the strips 14 and 13. The resultant double creased configuration of strips is shown in FIG. 3.

Figure 4:
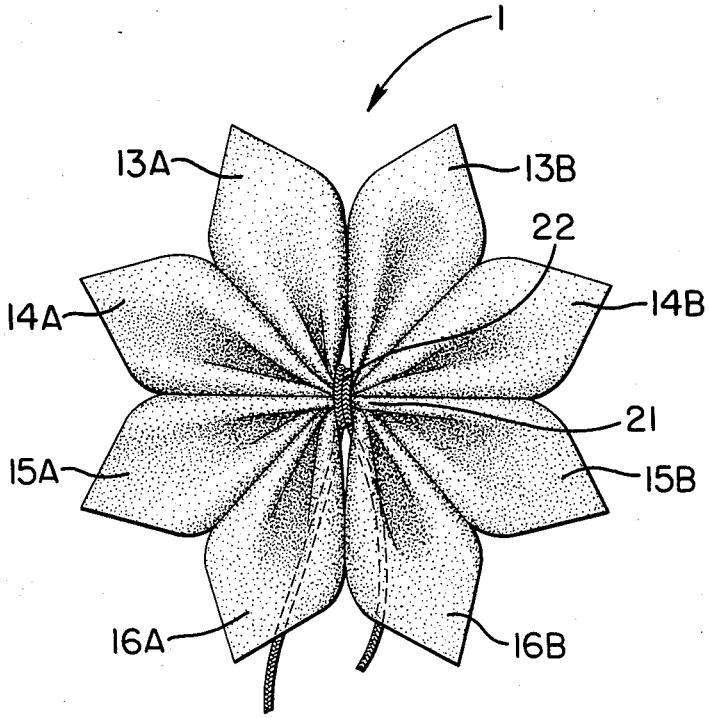
FIG. 4 illustrates the completed flower-like ornament resulting from the strips of material of FIG. 1.

Once strips 13–16 have been creased as above-described, they are held and compressed together at a common central region 21. A tie 22, such as a piece of wire encassed in a decorative sheath, is then wrapped around the common central region 21 and the ends of the tie 22 at the back surface of the strips are twisted to secure the strips in the compressed and held state. This results in the regions of the strips 13-16 extending longitudinally of the central region 21, taking petal-like forms 13A, 13B, 14A, 14B, 15A, 15B and 16A, 16B to create the resultant flower-like ornament as shown in FIG. 4. In practice, after the tie 22 is fixed to the strips, the strips may have to be bent or adjusted in various degrees to obtain the form shown in FIG. 4.

Figure 5:
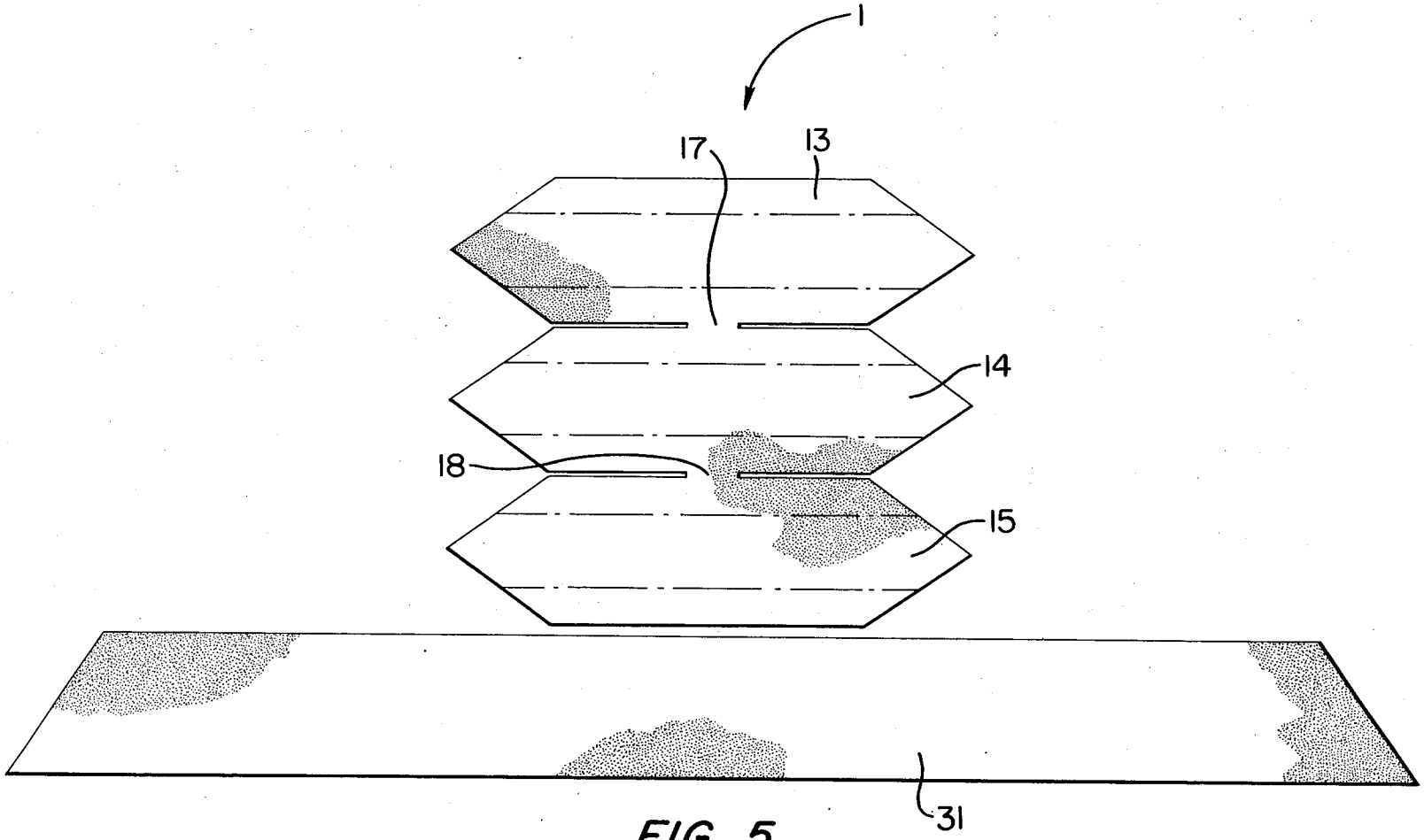
FIG. 5 illustrates a plurality of interconnected strips of material similar to those of FIG. 1 and used in conjunction with a further strip of material to form a flower-like ornament in accordance with a second aspect of the present invention.

FIG. 5 shows a further aspect of the present invention where it is desired that the petals 16A, 16B normally formed at the lower part of the flower-like ornament, be replaced by so-called "streamers" of extended length. In such case, the material 1 is formed to only have three strips 13-15 and a further strip 31 is used to form the streamers.

As seen in FIG. 5, the strip 31 is of substantially greater length than the length of the strips 13-15 and at it ends its upper edge inclines inwardly and meets the lower edge at a point. As shown, the strip is also entirely separate from the strips 13-15 but it may be connected thereto by a connecting area similar to connecting areas 17-18 of the strips 13-15.

Figure 6:
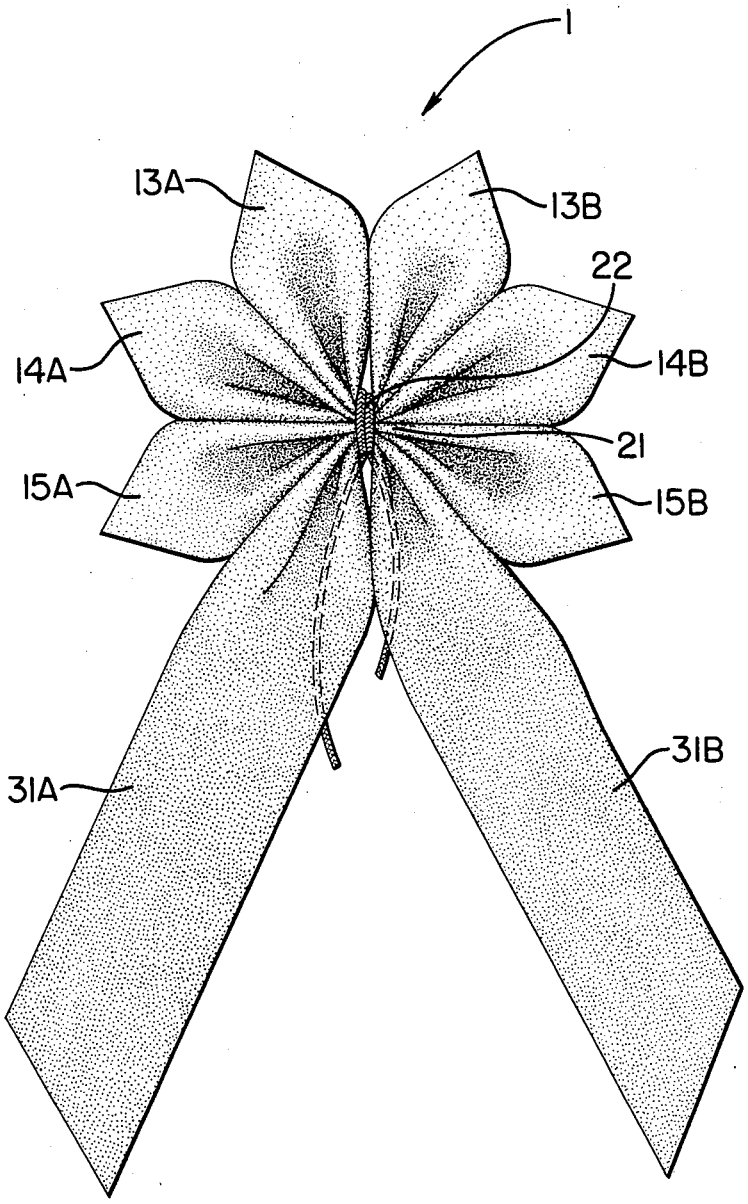
FIG. 6 illustrates the flower-like ornament resulting from the strips of material of FIG. 5.

The strips 13-15 and strip 31 are formed into a flower-like ornament in a substantially like manner as that previously discussed in connection with the ornament of FIGS. 1-4. However, in this case, the strips 13-15 are first all double creased and, thereafter, the strip 31 is double creased. The strips are then placed together and compressed and held at the common region 21 with a tie 22 as discussed previously. The resultant ornament is shown in FIG. 6, with the longitudinal portions 31A, 31B of the strip 31 beyond the common region 21 forming the desired streamers.

As can be appreciated, the number and dimension of the interconnected strips used to form the flower-like ornaments of the invention can be varied to obtain various sized and shaped flower-like ornaments. As long as the strips are interconnected as aforesaid, the advantages of quicker, easier and more symmetric fabrication can be realized.

In all cases, it is understood that the above-described arrangements are merely illustrative of the many possible specific embodiments which represent applications of the present invention. Numerous and varied other arrangements can readily be devised in accordance with the principles of the present invention without departing from the spirit and scope of the invention.

What is claimed is:

1. A flower-like ornament comprising:

a plurality of adjacently arranged elongated strips of material, each strip of material being connected to an adjacent strip of material over a limited area central of said strip, said limited areas of connection of said strips being in substantial alignment, the strips being creased along their lengths and being compressed and held together at a common region aligned with said limited areas of connection of said strips, whereby the portions of the strips extending oppositely from the common region form petal-like shapes and together a flower-like configuration.

2. A flower-like ornament in accordance with claim 1 wherein:

said plurality of strips are formed from a single piece of material having at successive positions spaced along its width cuts extending longitudinally inwardly from opposite longitudinal edges and ending inwardly short of one another.

3. A flower-like ornament in accordance with claim 1 wherein:

the longitudinal ends of each strip end in a point.

4. A flower-like ornament in accordance with claim 3 wherein:

each of strips at each of its longitudinal ends has upper and lower surfaces which incline linewise inwardly to said point.

5. A flower-like ornament in accordance with claim 1 wherein:

said number of strips is four

6. A flower-like ornament in accordance with claim 1 further comprising:

a further strip of material of longer overall length than each of said plurality of strips and being situated adjacent the lowermost of said plurality of strips, said further strip of material being creased along its length and being compressed and held together with said plurality of strips at said common region such that the portions of said further strip extending oppositely from said common region form streamers for said flower-like configuration.

7. A flower-like ornament in accordance with claim 6 wherein:

the number of said plurality of strips is three.

8. A flower-like ornament in accordance with claim 6 wherein:

said further strip is separate from said plurality of strips.

9. A flower-like ornament in accordance with claim 1 wherein:

each of said strips has a front face of flocked material.

10. A flower-like ornament in accordance with claim 1 further comprising:

means for tying said strips of material together at said common region.

11. A flower-like ornament in accordance with claim 10 wherein:

said tying means comprises wire encassed in a outer sheath, said encassed wire being wound about said common region and having its ends twisted to tightly hold said strips together at said common region.

12. An article for use in forming a flower-like ornament comprising:

a plurality of flat, elongated strips of material, each of said strips of material being connected to an adjacent strip of material over a limited area central of said strip, said limited areas of connection of said strips being in substantial alignment.

13. An article for use in forming a flower-like ornament in accordance with claim 12 wherein:

said plurality of strips are formed from a single piece of material having at successive positions spaced along its width cuts extending longitudinally inwardly from opposite longitudinal edges and ending inwardly short of one another.

14. An article for use in forming a flower-like ornament in accordance with claim 12 wherein:

each of said strips at each of its longitudinal ends has upper and lower surfaces which incline linewise inwardly to meet at a point.

15. A method of forming a flower-like ornament from a plurality of adjacently arranged strips of material, each of said strips of material being connected to an adjacent strip of material over a limited area central of said strip, said limited areas of connection of said strips being in substantial alignment, the method comprising:

creasing each strip along its length while bringing an adjacent strip toward the creasing area and in alignment with the creased strip via the limited connecting area, until all said strips having being creased;

compressing and holding said strips together at a common region aligned with said limited areas of connection of said strips;

and securing said strips in said compressed and held state.

* * * * *